United States Patent [19]

Madsen et al.

[11] 4,217,867

[45] Aug. 19, 1980

[54] LOW OVERSHOOT ENGINE SPEED GOVERNOR

[75] Inventors: Wayne A. Madsen, Birch Run; Roland G. Kibler, Flushing; Jeffrey A. Ely, Flint, all of Mich.

[73] Assignee: General Motors Corporation, Detroit, Mich.

[21] Appl. No.: 43,314

[22] Filed: May 29, 1979

[51] Int. Cl.[2] ..... F02M 7/00; F02B 33/00

[52] U.S. Cl. ..... 123/350; 180/178

[58] Field of Search ..... 123/102; 180/105 C; 317/5

[56] References Cited

U.S. PATENT DOCUMENTS

| | | | |
|---|---|---|---|
| 4,120,373 | 10/1978 | Fleischer | 123/102 |
| 4,134,373 | 1/1979 | Kibler | 123/102 |

*Primary Examiner*—Ronald B. Cox

*Attorney, Agent, or Firm*—Warren D. Hill

[57] ABSTRACT

A governor circuit for limiting the maximum speed of an internal combustion engine is effective to minimize overshoot at all ranges of engine acceleration. The system includes a circuit responsive to the engine speed which provides control signals to a solenoid valve which, in turn, controls a vacuum actuator which can override a manual throttle control to move the throttle toward closed position when a governed engine speed is approached. A control circuit provides a signal having a lead component and an integrated signal which comprises a stabilizing component and an integrated speed component. The integrated signal is provided by an integrator having a low sensitivity and high gain at low engine accelerations and a high sensitivity and low gain at engine accelerations above a predetermined switch point. The resulting control signal controls a duty cycle oscillator which actuates the solenoid valve.

4 Claims, 3 Drawing Figures

LOW OVERSHOOT ENGINE SPEED GOVERNOR

Figure 1:
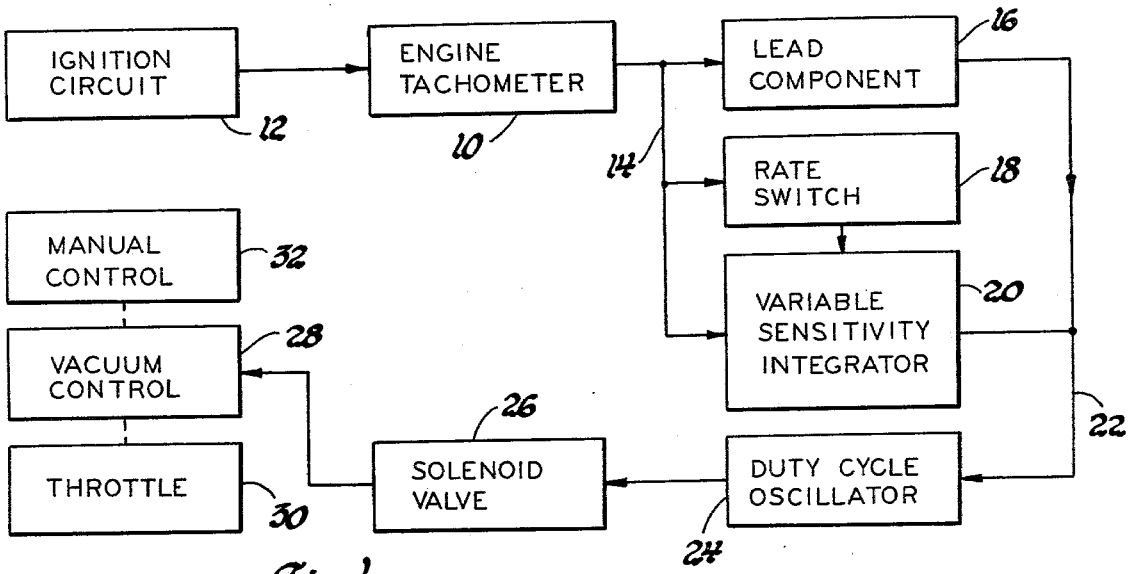

This invention relates to an engine speed governor and particularly to an electronic circuit for controlling engine speed with a minimum amount of overshoot of the desired maximum speed.

It is common practice to provide governors on truck engines to prevent sustained speeds which are inefficient or harmful to the engine. Normally, engine speed increases relatively slowly toward the governed speed during truck operation so that the governing operation is easily carried out. However, there are abnormal situations when very rapid engine acceleration occurs so that the speed limiting control must anticipate an overspeed condition in order to make a correction time to avoid engine damage. This might occur, for example, when the vehicle transmission is in neutral or the clutch disengaged and the acceleration pedal is depressed to rapidly drive the engine from idle speed to critical speed. Such potential overspeed conditions are also present in low and middle transmission ranges.

One proposed control circuit for limiting engine speed is disclosed in the U.S. patent to Kibler et al U.S. Pat. No. 4,134,373. The subject control circuit, however, is an improvement over that prior circuit in that it is more easily manufactured since it is not necessary to calibrate the duty cycle oscillator and further it reduces engine speed overshoot while at the same time maintains high reload. Overshoot is defined as the peak engine speed attained above the steady state governed speed and reload is the highest speed at which full power can be attained without engaging governor control under steady state conditions.

It is, therefore, a general object of this invention to provide an improved electronic engine speed governor having low overshoot at all engine acceleration conditions. It is a further object to provide such a governor having maximum reload.

The invention is carried out by providing a control circuit responsive to engine speed which includes means to generate a lead term component, variable sensitivity integrator responsive to engine speed to operate at a low sensitivity during low accelerations and at a high sensitivity during accelerations higher than a predetermined value to produce an integral term in the control signal, a rate switch responsive to engine acceleration to control the sensitivity of the integrator at the predetermined acceleration level, and a differentiator responsive to the speed signal for supplying an input to the integrator to effect a pseudoproportional stabilizing term in the control signal.

The invention further encompasses an integrator feedback control subject to the state of the rate switch to effect high integrator gain during low sensitivity operation and low gain during high sensitivity operation.

Figure 2:
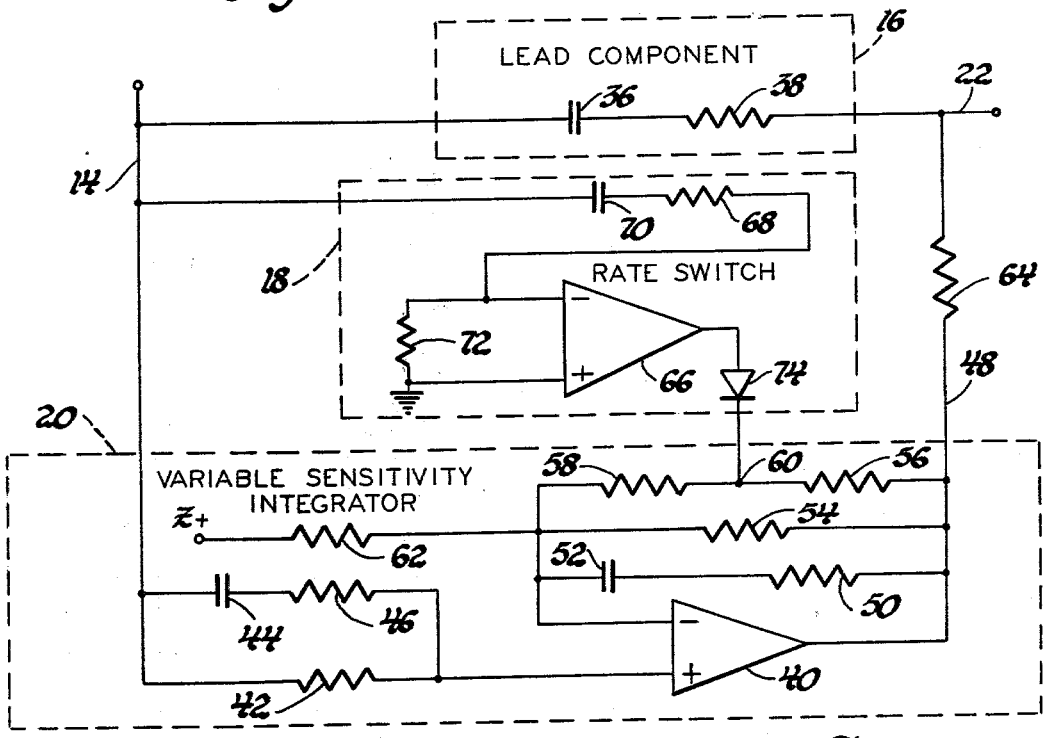
Figure 3:
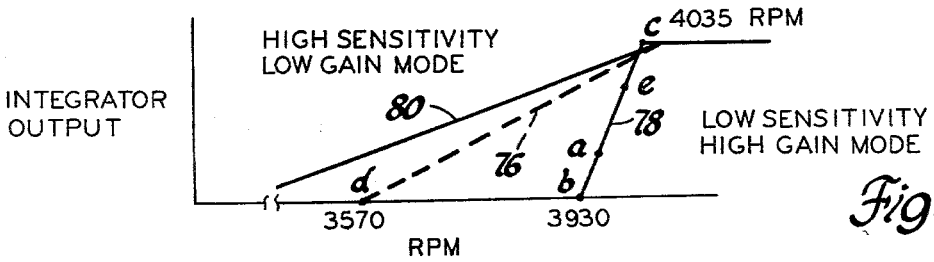

The above and other advantages will be made more apparent from the following specification taken in conjunction with the accompanying drawings wherein like reference numerals refer to like parts and wherein:

FIG. 1 is a block diagram of the engine speed governor according to the invention, FIG. 2 is a schematic circuit diagram of the lead component circuit the rate switch in the dual gain integrator of FIG. 1, and FIG. 3 is a diagram of integrator output versus engine speed to illustrate the effects of the dual gain operation.

The engine speed limiting system is shown in the block diagram of FIG. 1. An engine tachometer 10 responsive to pulses from the engine ignition circuit 12 produces on line 14 a direct voltage proportional to engine speed. The speed signal is then fed to the control circuit which includes a lead component circuit 16, a rate switch 18 and a variable sensitivity integrator circuit 20 which, acting in concert, produce a control signal on line 22 which is fed to and controls the duty cycle of a duty cycle oscillator 24. The duty cycle will be 0 percent when no engine speed limiting is required and will increase generally proportionately to the control signal on line 22. The oscillator 24 output controls a solenoid valve 26 which, in turn, energizes a vacuum actuator 28 which is positioned in a throttle linkage between the throttle 30 and the manual throttle (accelerator pedal) control 32. The overall operation of the system is such that when the engine speed signal on line 14 increases in such a manner that there is a danger of the engine exceeding its governed speed, the vacuum actuator will be energized to override the manual control 32 to move the throttle 30 toward its closed position. The degree of throttle closing will be generally proportional to the duty cycle of the oscillator 24 and hence proportional to the control signal on line 22.

The modifying circuit is shown in detail in FIG. 2. The lead component circuit 16 is a differentiator comprising a capacitor 36 and a resistor 38 connected serially between line 14 and line 22. Thus, the output of the lead component circuit 16 is proportional to the engine acceleration as revealed by the rate of change of the speed signal on line 14 and will be of substantial value under high engine acceleration conditions. As is well known, such a lead signal is useful to anticipate overshoot during the high acceleration conditions where overshoot is the most difficult to control. On the other hand, the lead component introduces instability at the governed speed if not compensated for.

The variable sensitivity integrator 20 has at its heart an operational amplifier 40 of the Norton type having its positive input terminal connected through an input register 42 to the line 14. A differentiator comprising a capacitor 44 and resistor 46 in series is connected across the resistor 42. The output of the amplifier 40 is connected to a line 48. A feedback circuit from line 48 to the negative input terminal of the operational amplifier 40 comprises a resistor 50 and a capacitor 52 in series. In addition, another feedback resistor 54 in parallel with the components 50 and 52 connect the line 48 with the negative input terminal of the amplifier 40. Still a third feedback path effective only during a low gain mode comprises resistors 56 and 58 in series joined at a junction point 60. Input bias current to the amplifier is primarily provided by a voltage source Z+ connected through a resistor 62 to the negative input of the amplifier 40. The bias signal, of course, determines the current level which must be achieved by the input circuit to initiate an output signal. The output signal of the circuit 20 is supplied through a serial resistor 64 to line 22 where it is combined with the lead term from the circuit 16 to establish the control signal from the duty cycle oscillator 24.

The rate switch 18 comprises an operational amplifier 66 of the Norton type having its negative input terminal connected through series connected resistor 68 and capacitor 70 to line 14 carrying the speed signal. The negative input terminal of the amplifier 66 is connected by a resistor 72 to the positive input terminal which is grounded. The amplifier 66 output is connected to the anode of a diode 74, the cathode of which is connected to the junction point 60 between the resistors 56 and 58. The operational amplifier is internally constructed to assume a high output when the inputs are near ground potential. At very low engine accelerations no significant current flows through a capacitor 70 and the amplifier 66 output is high causing current flow through the diode 74. During moderate and high accelerations, preferably above a rate switch point of approximately 60 rpm/sec., current flow through the capacitor 70 directed to the negative input of the amplifier 66 causes the amplifier to switch to a low voltage to backbias the diode 74. When the diode 74 is backbiased, the low integrator gain is determined by the net impedance of the three feedback networks including components 50–58 and the bias current is established solely by that current flowing through the resistor 62. The small bias current from the resistor 62 allows the integrator to respond to relatively small input signals, i.e. the integrator sensitivity is relatively high. Thus, as a result of the engine acceleration being above the rate switch point, an integrator output is produced to contribute to the control signal on line 22 to support governing action even at moderate speeds. In the case of very low engine acceleration, the diode 74 is conducting to supply through resistor 58 an additional bias current which combined with that flowing through resistor 62 lowers the integrator sensitivity and establishes a relatively high set speed, which is near the desired governed speed of the engine. The current flow into the junction point 60 renders the resistor network 56, 58 ineffectual as a feedback impedance path thereby increasing the net feedback impedance to that established by the components 50, 52 and 54 thereby causing the integrator to be in its high gain mode. The operational amplifier output serves as a current sink for the current flowing through the resistor 56.

The circuit 20 described herein as an integrator is commonly termed an integrator by those skilled in the art, yet it is not an ideal integrator in the mathematical sense. When in the high gain mode, the feedback circuit has a long time constant on the order of a few seconds. Thus rapidly changing input signals are effectively integrated while for slowly changing input signals the circuit serves as an amplifier. When in the low gain mode, the time constant is smaller and the integrator, in response to rapidly changing input signals such as those representing acceleration, produces an amplified output which resembles the input, although the response to the input changes is slightly delayed.

As a consequence of this circuit action a unique stabilizing signal is produced. During low gain integrator mode the differentiator input results in an integrator output component which is a quasi-lead term that reinforces the lead term of circuit 16 to help anticipate the overspeed. During high gain integrator mode the same input results in a speed proportional term or stabilizing term which compensates for the instability induced by the lead term. Thus, in each mode the output component due to the differentiator input has a salutory effect on the system operation.

FIG. 3 is a graph of integrator output voltage versus engine speed for an exemplary engine. The solid line 78 depicts the high integrator gain occurring in the vicinity of governed speed (point a) at steady state conditions. The set speed at point b is 3930 rpm while the full load governed speed is 4000 rpm. When the engine is accelerating at some value less than the rate switch point of 60 rpm/sec., the dynamic input signal can drive the integrator output to small values at speeds slightly lower than the set point b. Even at these low accelerations a small lead term from circuit 16 is generated so that the net control signal will be effective to gently modulate throttle position at speeds somewhat below point b. In the event the acceleration continues into the vicinity of the governed speed the control signal will increase according to the ramp 78 and will close the throttle enough to control the speed to about point c (4035 rpm) at the top of the ramp 78. The resulting deceleration will allow the control signal which is now speed limited to decrease along the ramp 78 until it finally settles at the full load governed speed, point a or a slightly higher governed speed at reduced load. Due to the stabilizing term the system is quiescent at the governed speed in spite of small perturbations.

At acceleration values above the rate switch point of 60 rpm/sec., the diode 74 is backbiased so that the input bias to the negative terminal of the amplifier 40 is decreased to the value of the current provided by the resistor 62. Thus, the value of the input current to the amplifier 40 required to produce an integrator output is much lower. Therefore, the integrator is more sensitive to the input signal on line 14 than in the case of the high gain mode. In FIG. 3, the point d which occurs at 3570 rpm represents the highest set point speed which could occur in the moderate acceleration range. At higher accelerations, the integrator set point will move to progressively lower speeds. This occurs because the input differentiator 44, 46 responds to the engine acceleration so that the actual integrator output signal will occur at speeds much lower than that directed by the proportional speed input alone. When the rate switch operation changes the set point to a lower value, it simultaneously changes the integrator gain to the lower value so that the slope of the integrator output curve, as shown in the dashed lines 76 in FIG. 3, is much less than the slope of the high gain ramp shown in solid lines 78 but is sufficient to achieve integrator saturation at approximately the point c at the top of the high gain ramp. This design minimizes discontinuity of operating points when the rate switch changes from low to high state. As engine acceleration increases above the 60 rpm/sec. value, the speed set point decreases below the point d. In addition, at higher accelerations the slope of the integrator output becomes flatter so that, as indicated by the solid line 80 in FIG. 3, the actual operating curve of the integrator lies somewhat to the left of the line 76 and the line 80 converges with the line 76 in the general neighborhood of point c. The effect of this dynamic integrator action is that at moderate engine accelerations, the integrator is very sensitive to increasing speed signals on line 14 to produce a substantial integrator output sufficiently early in time to anticipate and minimize engine overshoot. Of course at these substantial accelerations, the lead term component from surface 16 is additive in the effect on the overshoot anticipation.

At high engine acceleration, say over 1000 rpm/sec., the control operates as described for moderate acceleration. However, the lead term component from circuit 16 is clearly dominant and can occur at very low engine speeds. This is supported by the quasi-lead term from the integrator which can also occur at low speed. By circuit design the effects of the various contributions to the control signal are balanced under all acceleration conditions to insure that the integrator output will be at the proper operating voltage just as the engine speed reaches governed speed to provide a smooth transition from acceleration limiting to speed limiting. Whether operating in the high or the moderate engine acceleration condition, when the engine speed reaches the vicinity of the governed speed, the throttle closing will have reduced the engine acceleration to a value below the rate switch threshold and quickly stops acceleration or causes deceleration. The return of the integrator to the high gain mode causes it to produce an output component which changes in proportion to the changes in speed. This component is a stabilizing signal which compensates for the dynamic instability caused by the rapidly changing lead term component from circuit 16. Then, as in the lower acceleration case, the integrator output signal moves along the ramp 78 until it settles at the governed speed.

The full load governed speed at point a has been referred to above. The governed speed does vary, however, due to the vehicle load. For a no load condition the governed speed is higher, say at point e. The effect of the high gain integrator is to keep the full load and no load governed speed close together due to the steep ramp 78 prevailing at steady state conditions. Also the reload point b is very close to the full load governed speed thereby maximizing the speed at which full engine power can be produced at steady state conditions. The amount of overshoot allowed by the circuit according to this invention is on the order of 50 to 100 rmp above governed speed depending on the operating conditions. This is a significant improvement over prior governor circuits.

It will thus be seen that the governor according to this invention provides excellent control of overshoot under any acceleration rate while maintaining stability at steady state governed speed and achieving maximum reload speed.

The embodiments of the invention in which an exclusive property or privilege is claimed are defined as follows:

1. In a system for limiting engine speed to near a governed value having means for limiting engine speed, a control circuit for actuating the limiting means comprising, speed means for producing an electrical speed signal proportional to engine speed, a modifying circuit responsive to the speed signal for producing a control signal for energizing the limiting means as a function of engine speed, the modifying circuit including a lead circuit providing a lead term in accordance with engine acceleration, and a variable sensitivity integrator in parallel with the lead circuit, each providing components of the control signal, the variable sensitivity integrator connected to the speed means and selectively placed in a low sensitivity mode effective during low engine acceleration and in a high sensitivity mode effective during intermediate and high engine acceleration, the integrator including sensitivity adjustment means, and rate means connected to the speed means and responsive to the engine acceleration and connected to the sensitivity adjustment means of the integrator for effecting the respective high and low sensitivity integrator modes, the integrator input impedance including a differentiator responsive to the speed signal for producing a stabilizing component in the output signal, whereby the control circuit is conditioned to actuate the limiting means for limiting engine speed to a governed value for all values of engine acceleration.

2. In a system for limiting engine speed to near a governed value having means for limiting engine speed, a control circuit for actuating the limiting means comprising, speed means for producing an electrical speed signal proportional to engine speed, a modifying circuit responsive to the speed signal for producing a control signal for energizing the limiting means as a function of engine speed, the modifying circuit including a lead circuit providing a lead term in accordance with engine acceleration, and a variable sensitivity and gain integrator in parallel with the lead circuit, each providing components of the control signal, the variable sensitivity and gain integrator connected to the speed means and selectively placed in a low sensitivity/high gain mode effective during low engine acceleration and in a high sensitivity/low gain mode effective during intermediate and high engine acceleration, and a rate switch connected to the speed means and responsive to the engine acceleration for assuming a first switch state above a set acceleration switch point and a second switch state below the set switch point, and means connected to the rate switch and responsive to the state thereof for adjusting the integrator feedback impedance and input bias current so that when the rate switch is in its first state the integrator has a low gain and high sensitivity to small input signals and when in its second state the integrator has a high gain and a lower sensitivity to small input signals, the integrator input impedance including a differentiator responsive to the speed signal for producing a stabilizing component in the output signal when the integrator is in high gain mode and a further lead term when in low gain mode;

whereby the control circuit is conditioned to actuate the limiting means for limiting engine speed to a governed value for all values of engine acceleration.

3. In a system for limiting engine speed to near a governed value having means for limiting engine speed, a control circuit for actuating the limiting means comprising, speed means for producing an electrical speed signal proportional to engine speed, a modifying circuit responsive to the speed signal for producing a control signal for energizing the limiting means as a function of engine speed, the modifying circuit including a lead circuit providing a lead term in accordance with engine acceleration, and a variable sensitivity integrator in parallel with the lead circuit, each providing components of the control signal, the variable sensitivity integrator connected to the speed means and selectively placed in a low sensitivity mode effective during low engine acceleration and in a high sensitivity mode effective during intermediate and high engine acceleration, the integrator comprising an operational amplifier having a first input terminal, an integrator input impedance connected to the first input terminal including a differentiator responsive to the speed signal for producing a stabilizing component in the output signal, a feedback path connected between the amplifier output and a second input terminal to establish integrator action, input bias current means connected to the second input terminal to determine a nominal sensitivity level, and sensitivity control means for selectively supplying additional bias current to the input to decrease the sensitivity including a rate switch connected to the speed means and responsive to the engine acceleration and coupled to the said second input terminal to selectively apply the additional bias current thereto, whereby the control circuit is conditioned to actuate the limiting means for limiting engine speed to a governed value for all values of engine acceleration.

4. In a system for limiting engine speed to near a governed value having means for limiting engine speed, a control circuit for actuating the limiting means comprising, speed means for producing an electrical speed signal proportional to engine speed, a modifying circuit responsive to the speed signal for producing a control signal for energizing the limiting means as a function of engine speed, the modifying circuit including a lead circuit providing a lead term in accordance with engine acceleration, and a variable sensitivity and gain integrator in parallel with the lead circuit, each providing components of the control signal, the variable sensitivity and gain integrator connected to the speed means and selectively placed in a low sensitivity/high gain mode effective during low engine acceleration and in a high sensitivity/low gain mode effective during intermediate and high engine acceleration, the integrator comprising an operational amplifier having a capacitive feedback path, a first resistive feedback path and a second feedback path including a pair of resistors in series connected at a junction point, the feedback paths connected in parallel between the amplifier output and input whereby the feedback path establishes the gain of the integrator, a sensitivity circuit including input bias current means connected to the amplifier input, control means for increasing the gain and decreasing the sensitivity by applying a high voltage at the said junction point to augment the input bias current and to disable the second resistive path, the control means including a rate switch connected to the speed means and responsive to the engine acceleration and connected to the said junction point to selectively apply the voltage thereto for effecting the respective sensitivity and gain changes, the integrator input impedance including a differentiator responsive to the speed signal for producing a stabilizing component in the output signal when the integrator is in high gain mode and a further lead term when in low gain mode;

whereby the control circuit is conditioned to actuate the limiting means for limiting engine speed to a governed value for all values of engine acceleration.

* * * * *